United States Patent [19]

Paterson et al.

[11] Patent Number: 4,548,611

[45] Date of Patent: Oct. 22, 1985

[54] METHOD AND APPARATUS FOR DYEING TEXTILE YARN SUBSTRATES BY IMPACTING A FOAM

[76] Inventors: James G. T. Paterson, 114 Forrest St., S., Lookout Mountain, Tenn. 37350; Charles G. Whitener, Jr., P.O. Box 27578, Atlanta, Ga. 30327

[21] Appl. No.: 499,293

[22] Filed: May 31, 1983

[51] Int. Cl.[4] ..... D06P 7/00

[52] U.S. Cl. ..... 8/477; 8/149.1; 8/151.2; 8/500; 68/94; 68/202

[58] Field of Search ..... 8/477, 155, 500

[56] References Cited

U.S. PATENT DOCUMENTS 3,491,561 1/1970 Crump ..... 68/202

4,391,604 7/1983 Schomakers ..... 8/477

4,411,663 10/1983 Lauchenauer ..... 8/107

*Primary Examiner*—A. Lionel Clingman

*Attorney, Agent, or Firm*—James B. Middleton

[57] ABSTRACT

A method and apparatus for dyeing or otherwise treating yarns wherein the yarn is made into a substrate having tranvsersely laid yarns, foamed dye is placed on the substrate, and the foamed substrate is impacted to cause penetration of the foam through the substrate. The apparatus may include a hammer-like impactor acting against an anvil for impacting the foamed substrate, and the impactor may be driven by mechanical arrangements, or by ultrasonic sound drive means. The apparatus may also include impacting rollers wherein the diameter of the roller is small, and the rate of rotation high, so the rate of increase in pressure on the substrate by the rollers is equal to impaction.

7 Claims, 11 Drawing Figures

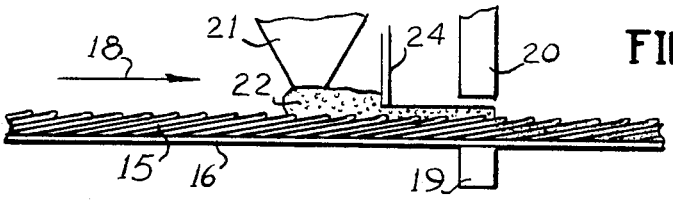
FIG. 1
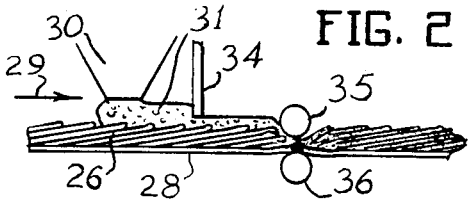
FIG. 2
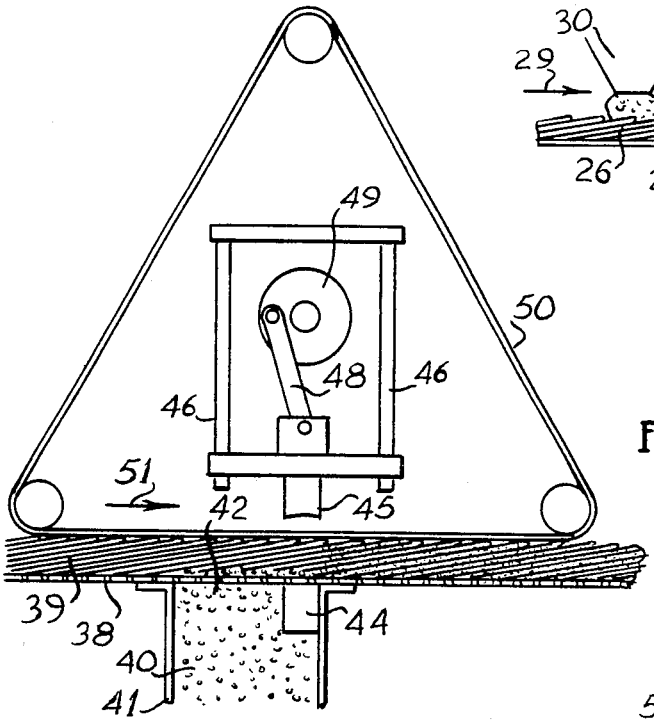
FIG. 3
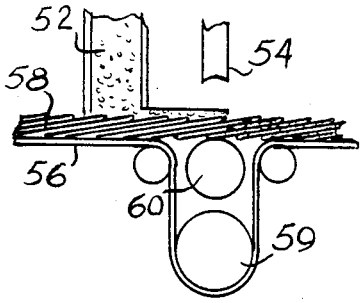
FIG. 4
FIG. 5
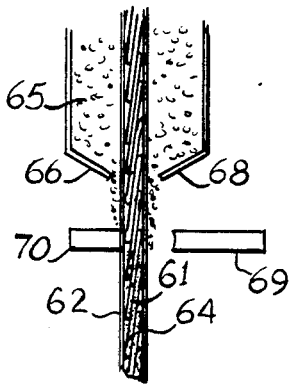

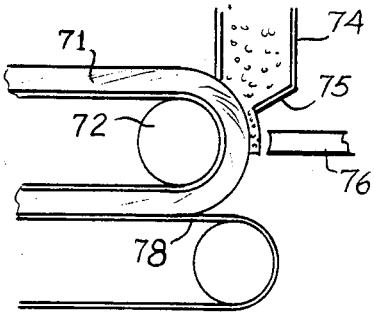
FIG. 6
FIG. 7
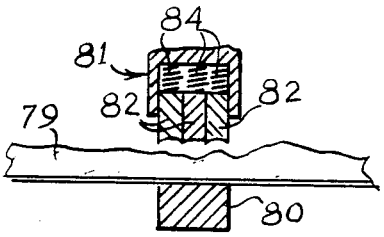
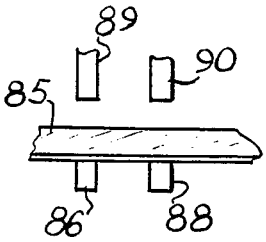
FIG. 8
FIG. 9
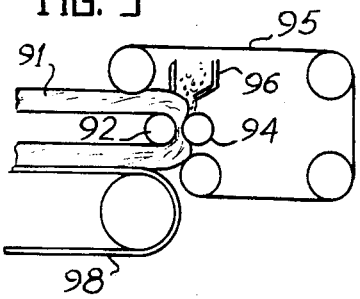
FIG. 10
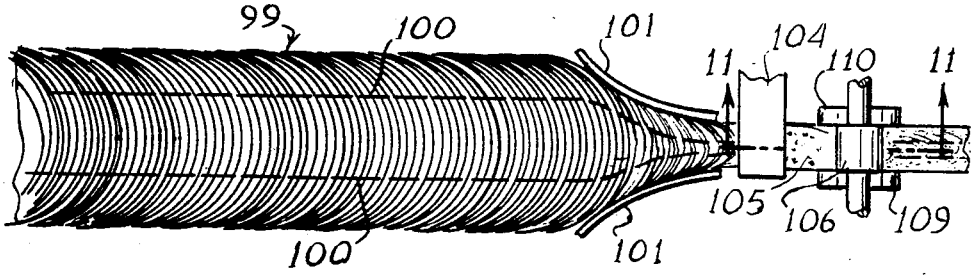
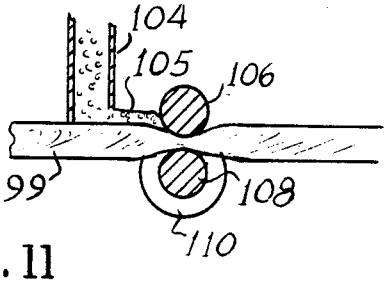
FIG. 11

METHOD AND APPARATUS FOR DYEING TEXTILE YARN SUBSTRATES BY IMPACTING A FOAM

INFORMATION DISCLOSURE STATEMENT

The dyeing or other chemical treatment of a coiled textile substrate is known in the prior art as is shown, for example, in the patent to Crump, U.S. Pat. No. 3,491,561, issued Jan. 27, 1970. The patent to Crump discloses the coiling of a yarn, and dyeing the coiled substrate in lateral stripes across the substrate. This patent does not disclose the use of foam, and does not disclose level dyeing of the yarn.

There has been considerable work done on the treatment of textile substrates with foamed dye or other chemical. Foams are desirable in applying chemical solutions to textile substrates because of their inherent potential for both uniformity of application and low wet pick up, but it has been difficult to cause the uniform delivery of foam to the entire substrate involved.

Efforts at causing penetration of foam into a textile substrate have included the placing of a foam on a substrate and applying a vacuum to the opposite side of the substrate to draw the foam through the textile substrate. Conversely, a foam has been applied to one side of a substrate, and the fluid pressure of the foam has been used to urge the foam through the textile substrate. Other efforts at causing a foam to penetrate a substrate have included the use of pinch rolls, doctor blades, and air jets.

In general, foams can readily be made to penetrate substrates having a columnar structure, such as cut pile carpeting, wherein the fibers or yarns are oriented in the direction of the desired movement of the foam. It is very difficult to make foams penetrate a substrate wherein the fibers or yarns are oriented transversely to the direction of the desired movement of the foam, and this has not previously been satisfactorily accomplished.

There has been some prior effort to cause penetration of dye or other chemical solutions into a textile substrate by impacting the textile substrates. A liquid has been applied directly to the surface of the substrate, and impacted to cause penetration of the liquid into the substrate. Also, the liquid has been absorbed within a carrier belt, such as felt or the like, the carrier belt placed against the substrate, and the two impacted to cause liquid from the carrier belt to penetrate the substrate. While these techniques will cause penetration of the liquid into a substrate—both a columnar and a transversely laid up substrate—it is difficult to achieve the uniformly thin layer of liqud for low wet pick up when the liquid is applied directly; and, the carrier belts are subjet to rapid deterioration under impacting. Impaction has been carried out in prior art apparatus by reciprocatory impaction, and by continuous impaction by means of high speed rollers.

SUMMARY OF THE INVENTION

This invention relates generally to the treating of textile substrates, and is more particularly concerned with a method and apparatus for applying a foamed solution to a substrate and causing penetration by impaction.

The present invention comprises a method and apparatus for dyeing or otherwise treating a textile substrate. Though the textile substrate may take almost any form, the present invention has particular utility in the treating of substrates that include transversely laid yarns or fibers. In one embodiment of the invention, the substrate comprises a single yarn laid with transverse portions, such as a coiled yarn or the like. In accordance with the present method, the treating chemical is foamed and applied to at least one side of the substrate, and the substrate with the foam applied thereto is impacted to cause the foam to penetrate the entire thickness of the substrate. The application of the foam in accordance with the present invention may be by any known means in order to provide uniform application of foam throughout the substrate, and the foam may be applied to one or both sides of the substrate. The impaction may take the form of a reciprocatory striking motion, as by a hammer or the like, or the impaction may take the form of a continuous motion, as by high speed rollers. The substrate itself may be placed on a belt or other carrier and remain on the belt for the complete processing; or, the substrate can be laced, roped, or otherwise held together for processing without a separate carrier.

BRIEF DESCRIPTION OF THE DRAWINGS

These and other features and advantages of the present invention will become apparent from consideration of the following specification when taken in conjunction with the accompanying drawings in which:

FIG. 1 is a rather schematic elevational view showing application of foam to a substrate and showing apparatus for reciprocatory impaction;

FIG. 2 is a view similar to FIG. 1 showing continuous impaction by a pair of rollers;

FIG. 3 is a cross-sectional view showing a different means for application of foam, and showing apparatus for causing reciprocatory impaction;

FIG. 4 is a view similar to FIGS. 1 and 2 showing a modified anvil arrangement;

Fig.5 is a cross-sectional view showing application of foam to both sides of the substrate with a vertically moving substrate;

FIG. 6 is a cross-sectional view showing another modified form of anvil arrangement;

FIG. 7 is a cross-sectional view showing a modified form of impactor;

FIG. 8 is a cross-sectional view showing a pair of impactors as may be used in the present invention;

FIG. 9 is a view similar to FIG. 6 but showing continuous impaction by a pair of rollers;

FIG. 10 is a top plan view illustrating a substrate laced together for use without a carrier belt, and further showing roping and continuous impaction; and, FIG. 11 is a cross-sectional view taken substantially along the line 11—11 in FIG. 10.

DETAILED DESCRIPTION OF THE EMBODIMENTS

Referring now more particularly to the drawings, and to those embodiments of the invention here presented by way of illustration, FIG. 1 shows a substrate 15 carried by a belt or the like 16. The belt 16 with the substrate 15 carried thereon moves from left to right as shown in the drawings, as indicated by the arrow 18.

Below the belt 16, there is a stationary member, or anvil, designated at 19; and, above the anvil 19 and aligned therewith, there is an impactor 20. Though no specific means is here illustrated, it will be understood that the impactor 20 is arranged for reciprocatory motion towards and away from the anvil 19 for impacting the substrate 15 after the foam has been applied.

There is a means for supplying a quantity of foam 22 for deposition on the upper surface of the substrate 15. The foam 22 is doctored by a doctor blade 24 to a substantially uniform thickness, so the doctor blade 24 acts as a means for providing a uniform application of foam to the substrate 15. The uniform thickness of foam 22 will be carried beneath the impactor 20. The impactor 20 will be moving continually to strike the upper surface of the substrate 15, causing the foam 22 to penetrate the substrate 15 and be dispersed uniformly therethrough. This process will be discussed in more detail hereinafter.

Looking now at FIG. 2 of the drawings, there is a substrate designated at 26 carried by a belt means 28, the belt 28 with the substrate 26 moving in the direction indicated by the arrow 29. The means 30 dispenses foam 31 onto the upper surface of the substrate 26, and the foam 31 is doctored to a uniform thickness by means of a doctor blade 34. In this embodiment of the invention, it will be seen that there are two rolls 35 and 36, and the substrate 26 with the foam 31 passes through the nip of these two rolls. The rolls 35 and 36 are of such size, and rotated at such speed, that the result is a continuous impaction of the foam 31 and the substrate 26 which causes the foam to penetrate and be distributed throughout the thickness of the substrate 26.

Turning to FIG. 3 of the drawings, there is a belt 38 carrying the substrate 39. In this embodiment of the invention the belt 38 is necessarily perforated to allow the foam 40 to pass through the belt 38. It will be seen that there is a box 41 containing the foam 40, and an opening 42 in the top of the box 41 allows the foam 40 to pass from the box 41, through the belt 32 and to the lower side of the substrate 39.

Those skilled in the art will understand that the foam 40 may be generated remotely and piped to a container such as the box 41, or the foam 40 may be generated within the box 41. In either case, the box 41 becomes the foam dispensing means, and the foam rises from the box 41, through the belt 38 and to the lower surface of the substrate. Those skilled in the art will also understand that metering of the foam 40 will be achieved by generally conventional means. It is well known to meter the amount of liquid and the amount of air to yield a predetermined quantity of foam, and such methods and apparatus are known in the art.

At one edge of the box 41 there is a permanently mounted anvil 44; and, above the anvil 44 there is a reciprocating impactor 45. As here shown, the impactor 45 rides on guide rods 46, and is moved by means of a pitman 48 connecting the impactor 45 to an eccentric 49. An apron 50 may be placed between the impactor 45 and the substrate 39 to keep the impactor 45 clean, and to prevent the buildup of dye or other treating substance on the impactor 45.

It will therefore be seen that foam is appropriately metered and is dispensed from the box 41, and the foam passes through the opening 42 to the lower surface of the substrate 39. As the belt 38 with the substrate 39 moves in the direction indicated by the arrow 51, the impactor 45 will impact the substrate and cause the foam to penetrate the substrate to be dispersed throughout the thickness of the substrate.

FIG. 4 of the drawings shows an arrangement similar to that shown in FIG. 1, the foam being dispensed at 52, immediately before an impactor 54. To protect the belt 55 which carries the substrate 58, the belt 56 is removed from the impacting area by passing the belt downwardly, around a roller 59. The substrate 58, then, passes from the belt 56, over a roller 60, then from the roller 60 back to the belt 56. The roller 60 becomes the anvil against which the impactor 54 acts.

FIG. 5 shows an arrangement wherein the substrate 61 is moving vertically, and there is a belt on each side of the substrate, the belts being indicated at 62 and 64. In this arrangement it will be seen that foam 65 is applied to both sides of the substrate 61, it being understood that the belts 62 and 64 are perforated to allow the foam 65 to engage the substrate 61. The lower edges 66 and 68 of the foam plenum may act as doctor blades to doctor the foam to a uniform application, or conventional metering as discussed in connection with the embodiment of FIG. 3 may be used. Immediately after application of the foam 61, the substrate is impacted by means of an impactor 69 acting against an anvil 70.

Yet another arrangement is shown in FIG. 6 wherein th substrate 71 passes around a roll 72. Foam is applied from the plenum 74, the lower edge 75 of the plenum 74 acting as a doctor blade to doctor the foam to a uniform application. Immediately beyond the doctor blade 75 there is an impactor 76 which acts against the roll 72 so the roll 72 is an anvil. In this embodiment of the invention it will be seen that, after the substrate 71 has been impacted, the substrate is placed onto a belt 78 which can carry the substrate 71 for further processing.

It will be understood that some substrates may not have a uniform upper surface. Since it is important to impact the substrate somewhat uniformly in order to obtain uniform penetration of the foam, the impactor may be divided into a plurality of pieces to allow the impactor to accommodate surface variations in the substrate. FIG. 7 shows a substrate 79 having an anvil 80 thereunder. Above the anvil 80, there is an impactor generally designated at 81, the impactor comprising a plurality of separate members 82, three such separate members 82 being here shown. It will be seen that each of the members 82 has a spring 84 thereabove. The result is that the impactor 81 is reciprocated towards and away from the anvil 80, and the springs 84 will hold the members 82 in their downward position until a member 82 contacts the substrate 79 with a force equal to the strength of its spring 84. After the force of the spring 84 is overcome, it will be understood that the member 82 will move rearwardly relative to the impactor 81. The result is that each of the members 82 will impact the substrate 79 with the same force, and no one member 82 will prevent proper impaction of a different portion of the substrate.

As will be discussed below, it may become necessary to have two or more separate impactors engaging the same substrate to obtain the desired production speed. FIG. 8 shows such an arrangement wherein there is a substrate 85 having two anvils 86 and 88 below the substrate 85. Above the anvils 86 and 88 are two separate impactors 89 and 90. It is contemplated that these impactors 89 and 90 will operate alternately to provide sufficient impaction on the substrate 85 to allow the substrate 85 to move at a reasonable production speed.

FIG. 9 of the drawings shows an arrangement similar to that shown in FIG. 6 of the drawings, but using the continuous impaction rather than the reciprocatory impaction. In the continuous impaction, the impacting rollers will generally be of relatively small diameter in an effort to get the desired impaction. In FIG. 9, it will be seen that the substrate 91 passes around the roller 92, which is one of the pair of rollers 92 and 94 that performs the impaction on the substrate 91. Since the roller 92 will be of relatively small diameter, some means may be required to force the substrate 91 to pass around the roller 92. In the apparatus shown in FIG. 9, this is accomplished by means of a belt-like arrangement 95 which engages one side of the substrate 91 to hold the substrate against the roller 92. The belt-like arrangement 95 may of course comprise a plurality of strings or the like to maintain a sufficiently open substrate for application of the treating foam.

As was discussed in conjunction with FIG. 6 of the drawings, the arrangement shown in FIG. 9 includes the foam plenum 96 for applying foam to the substrate 91 immediately before impaction. A conveyor 98 is provided to receive the substrate and carry it to the next processing.

Finally, attention is directed to FIGS. 10 and 11 of the drawings. It will be remembered that the foregoing discussion supposes that the substrate will be carried on a belt or the like, and must generally be held to be carried through processing of the substrate. Those skilled in the art will realize that the use of a belt or the like will sometimes be inconvenient or undesirable, and the present invention contemplates the processing of the substrate without a belt.

In FIG. 10 there is shown a substrate 99 formed of a single yarn, laid in coiled fashion. Such a substrate obviously has no integrity without some additional support, such as the belts discussed above. However, in FIG. 10 the coiled substrate 99 is laced or otherwise packaged as with the stitching 100. With the coiled substrate stitched throughout its length, it will be understood that the substrate 99 can be handled as required without the use of belts or other carrier means.

The laced substrate 99 may be maintained as shown, and carried through apparatus such as that shown in FIGS. 1–9, without belts or the like. The lacing or stitching 100 will provide the necessary integrity to the substrate. If desired, the substrate may be roped as is indicated in the right-hand portion of FIG. 10. Here it will be seen that, with the substrate 99 appropriately packaged, the substrate can be gathered, as by the condensing walls 101, to be made into a rope designated at 102. There is a plenum 104 for applying foam 105 to the rope; then, the rope is continuously impacted by the rollers 106 and 108.

To assure that the rope 102 remains within the confines of the rollers 106 and 108, the bottom roller 108 includes side flanges 109 and 110; and, the top roller 106 fits between the flanges to provide a discrete opening through which the rope 102 can pass. It is therefore assured that the entire rope will be impacted as desired to cause uniform penetration of the foam 105.

Whether the substrate is laced, or roped, or otherwise packaged, the packaging will be such that a yarn making up the substrate can be removed from the substrate without entanglement.

Returning now to the schematic presentation in FIG. 1 of the drawings, it will be realized that the substrate 15 is shown rather generally. While substrates of various types have been chemically treated in various ways, those skilled in the art have been unsuccessful in utilizing foam to treat a substrate including transversely laid yarn as in the present invention.

When a foam enters a textile substrate, the liquor that forms the walls of either individual bubbles or small groups of bubbles within the foam, wets the surrounding fibers. As the bubbles move into the substrate, they tend to carry their wall liquor with them, but leave some of their wall liquor on the fibers as they move along in contact with the fibers. As penetration continues, the bubbles become denuded of wall liquor to become dry bubbles, hence subject to rupture.

In a columnar substrate wherein the fibers are aligned in the direction of foam penetration, the bubbles tend to sweep a high proportion of their wall liquor along with them as they pass into the substrate. As a result, the liquor is carried a long way into the substrate before the bubbles become dry and collapse.

In a transversely laid substrate, the bubble wall liquor tends to run along the fibers, transversely to the direction of desired penetration. Thus, as the bubbles are propelled forward, they cannot carry much of their wall liquor with them from fiber to fiber, so the bubbles rapidly become denuded of wall liquor, become dry and are subject to rupture. Because of this process, foams passing into transversely laid substrates tend to condense within the outer layers of the substrate.

Any means intended to promote foam penetration that does not take into account the need to prevent decoupling of the foam bubbles from their wall liquor is likely to be detrimental to penetration. In using a pressure drop to cause foam to penetrate a columnar substrate, too great a pressure drop can propel bubbles forward faster than the bubbles can carry wetting liquor with them; and, air jets applied to foam on a substrate may have a similar effect, causing successive condensation to take place on the outer layers of the substrate. In normal padding using pinch rolls, the wetting out of a substrate is induced by squeezing the substrate fibers together, thereby forming capillaries. These capillaries tend to draw off the bubble wall liquor in a foam, leaving the bubbles behind. Since the pinch roll squeezing does not produce capillaries uniformly throughout a substrate, this process (used in the low wet pick up circumstances of foam dyeing) does not produce uniform results.

While impaction has previously been used to cause liquids to penetrate textiles, the treatment has not been sufficiently uniform. When textile substrates have been dyed using impaction to cause penetration, the dyeing has not exhibited the desired levelness.

Though it would be expected that impacting a foam would cause the foam to break down, it has been found that much of the foam survives and penetrates the substrate as foam. It is thought that, under the shock condition of impaction, the foam bubbles and their wall liquor are propelled forward into the substrate and have no opportunity to decouple and become dry, hence subject to rupture. Whether or not this theory of the action is precisely correct, it has been found that foam penetration of a substrate by impacting produces more nearly level application than unfoamed liquid penetration. Also, the foaming of the liquid helps to hold the solution in place after application. It will further be recognized that the use of a foamed solution improves the uniformity of application of chemical to the substrate, so this feature improves the levelness of application.

As is stated above, the foam penetrates the substrate as a result of the impaction. There may, however, be some migration of the dye or other chemical from the precise line of impaction. To alleviate this problem, the impact face of the impactor is made concave as shown in, for example, FIG. 3 of the drawings. The sharp side edges of the face confine the foamed chemical to the immediate area of impact.

It will further be recognized that, since each line across the substrate must be impacted, and impacted uniformly, there may be some difficulty in obtaining sufficient production speeds with the necessary uniformity. The arrangement shown in FIG. 8 is designed to overcome these problems by providing two impactors operating in tamdem. Each impactor 89 and 91 will strike the substrate 85 alternately. The impactor 89 will strike one space extending across the substrate 85, and the impactor 90 will subsequently strike one-half of that same space. The result is that each portion of the substrate is impacted twice, and each strike of the second impactor 90 covers half of two contiguous spaces struck by the impactor 89.

With the foregoing in mind, attention is directed to FIG. 2 of the drawings. It should be obvious that continuous impaction has the advantages of no reciprocatory motion, and uniformity in treatment of the substrate.

The impaction rolls 35 and 36 shown in FIG. 2 are different from the above discussed rolls for forcing foam into a fabric or the like, and are different from the conventional padding rolls used in dyeing and well known to those skilled in the art. In both these prior art rolls, the object has been to exert sufficient pressure on the goods to accomplish the goal. In the prior art foam application, the rolls have been used in an attempt to push the foam into the goods by simple mechanical pressure. In prior art padding, wetting out the substrate takes place largely through a combination of the entrapment of the liquor within the larger voids within the substrate, and the forming of capillaries between many of the fibers as the substrate passes through the nip of the padding rolls. The capillaries draw liquor into the substrate mainly from the liquor trapped within the voids. Wetting out does not take place uniformly except in the presence of excessive amounts of liquor; as a result, the typical wet pick ups are in excess of 300%.

The present invention does not utilize the compression induced formation of capillaries to wet out the substrate, but uses instead the rate of rise of pressure as the substrate begins to pass through the roll nip, to effect impaction. For this reason, it will be understood that the final intensity of pressure attained at the center of the nip is not as critical as the rate of increase of pressure from the start to the center of the nip.

Those skilled in the art will understand that when a substrate, such as the substrate 26, is passing between rolls such as the rolls 35 and 36, the rate of increase in pressure exerted by the rolls is inversely proportional to the radius of the rolls, and the increase in pressure is an exponential function. As a result, if the rolls 35 and 36 are small, the increase in pressure will be so rapid that the result is impaction rather than simple padding. It will therefore be understood that the foam is caused to penetrate the substrate during the rapid increase in pressure immediately before reaching the center of the nip between the rolls.

Thus, the present invention provides a method of dyeing or otherwise chemically treating yarn or other textile substrate wherein the substrate includes transversely laid yarns or fibers. The method includes the application of a foamed treatment liquid, such as dye, the foam preferably being a short-lived foam with little or no "doping" so the liquid before foaming has a very low viscosity, the viscosity approaching the viscosity of water. The foam is applied to the substrate, and the foam is impacted to cause the foam to penetrate the substrate and be dispersed therethrough. The impacting may take the form of a hammering as with a reciprocally moving impactor, and the impactor may be moved in any manner desired. Of course, ultra high frequency sound is highly desirable as a driving means because of the rapid impaction and the short motion used, though other mechanical arrangements are applicable also.

Alternatively, the impaction may be by means of rolls. When the substrate is fed past a roller such that the increase in pressure is very rapid, the effect is to impact the substrate and achieve the same results as the reciprocatory motion. While a pair of rolls has been illustrated, it will also be understood that a single roll opposing a flat moving surface may be used. Obviously, the size of the roller and the speed of the substrate must be selected to achieve the impaction since the use of a flat surface will change the rate of increase in pressure.

After the substrate has been impacted to cause the foam to be dispersed throughout the substrate, the yarn can be finished by known means, keeping in mind that the wet pick-up is quite low using the method of the present invention. Though the percentage will vary considerably depending on the fiber, the type of foam and other variables, the wet pick-up may be in the range of 20% to 50%.

It will of course be understood by those skilled in the art that the specific embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

We claim:

1. A method for dyeing yarn, wherein said yarn is formed into a substrate and said substrate is moved relative to a dispensing means, said substrate including yarns laid transversely to the direction of movement of dye into said substrate, said method including the steps of foaming said dye to produce foamed dye for dyeing said substrate, dispensing a layer of said foamed dye from said dispensing means on at least one surface of said substrate, and impacting said layer of foamed dye on said substrate for causing said foamed dye to penetrate said substrate, traversing said substrate in a direction transverse to the direction of the yarns in said substrate, to be dispersed throughout the thickness of said substrate.

2. A method as claimed in claim 1, characterized in that the step of impacting said layer of foamed dye is carried out by placing an anvil on one side of said substrate so that said substrate moves across said anvil when said substrate is moved relative to a dispensing means, placing an impactor on the opposite side of said substrate, and reciprocating said impactor towards and away from said anvil so that said impactor impacts said foamed dye on said substrate successively, between said impactor and said anvil.

3. A method as claimed in claim 1, characterized in that the step of impacting said layer of foamed dye is carried out by passing said substrate with said layer of foamed dye through impacting rolls arranged such that the increase in pressure on said substrate as said substrate approaches the center of the nip of said rolls is at a rate to cause impaction of said foamed dye on said substrate.

4. A method as claimed in claim 1, and further characterized in that a quantity of foamed dye is deposited on said substrate and doctored to a uniform thickness of foamed dye to provide said layer of foamed dye.

5. A method as claimed in claim 1, and further characterized in that said substrate is placed on a perforate belt and said perforate belt is moved with said substrate relative to said dispensing means, and said foamed dye is passed through said perforate belt to provide said layer of foamed dye.

6. A method as claimed in claim 3, characterized by the step of stitching together the yarn forming said substrate to give the substrate integrity before the step of placing a layer of foamed dye on a surface of said substrate.

7. A method as claimed in claim 6, and further characterized by the step of forming said substrate into a rope after the step of stitching together the yarn forming said substrate, then placing a layer of foamed dye on said substrate.

* * * * *